United States Patent [19]

Steinhagen

[11] Patent Number: 4,614,207

[45] Date of Patent: Sep. 30, 1986

[54] THREAD PROTECTOR

[75] Inventor: Thomas C. Steinhagen, Westminster, Colo.

[73] Assignee: The Gates Rubber Company, Colo.

[21] Appl. No.: 205,847

[22] Filed: Nov. 10, 1980

[51] Int. Cl.[4] ..... B65D 59/00

[52] U.S. Cl. ..... 138/96 T

[58] Field of Search ..... 138/96 R, 96 T, 103, 138/109, 110, 99, DIG. 6; 411/373, 437, 907, 908, 360; 16/2

[56] References Cited

U.S. PATENT DOCUMENTS

| | | | |
|---|---|---|---|
| 2,632,479 | 3/1953 | Pfeil et al. | 138/96 T |
| 3,000,402 | 9/1961 | Bowman | 138/96 T |
| 3,477,773 | 11/1969 | Altson | 308/214 |
| 4,033,380 | 7/1977 | Weber | 138/96 T |
| 4,157,100 | 6/1979 | Turk | 138/96 T |
| 4,202,378 | 5/1980 | Bush et al. | 138/96 T |
| 4,266,578 | 5/1981 | Swain et al. | 138/96 R |

FOREIGN PATENT DOCUMENTS

| | | | |
|---|---|---|---|
| 0352336 | 7/1931 | United Kingdom | 138/96 T |
| 1488393 | 10/1977 | United Kingdom | 138/99 |

*Primary Examiner*—Stuart S. Levy
*Assistant Examiner*—Daniel P. Stodola
*Attorney, Agent, or Firm*—H. W. Oberg, Jr.; C. H. Castleman, Jr.; Frank P. Grassler

[57] ABSTRACT

A thread protector with a generally sleeve-like cylindrically shaped body that has a perforate sidewall and protuberances for retaining the body to a threaded member.

11 Claims, 5 Drawing Figures

THREAD PROTECTOR

BACKGROUND OF THE INVENTION

The invention relates to protectors for threaded parts. Protectors are commonly placed juxtaposed threads of a part to minimize damage by handling such as during fabrication or shipment. Known protectors have imperforate sidewalls that are satisfactory to shield threads from mechanical damage or to cap or plug a bore at a threaded end to preclude contamination.

Some threaded parts must be electrochemically plated to make them corrosion resistant. In some instances, protectors are placed on threads immediately after they are formed to prevent damage when bumped with other parts. The protectors are removed for plating and the parts placed in spaced apart fashion in racks to ensure against thread damage. The racks are placed in a bath and the parts are plated. Protectors are replaced after plating to protect the threads until the parts are used. Of course, the first cycle of installing and removing the protectors may be eliminated when the initially formed parts are placed in spaced apart fashion in plating racks immediately after the threads are formed. In either case, the parts are individually placed in racks so there is minimal thread contact with other unplated parts. The problem of removing and replacing a thread protector during various part manufacturing stages and the requirement for rack plating unprotected threaded parts are sought to be overcome by the present invention.

SUMMARY OF THE INVENTION

In accordance with the invention, a thread protector is provided that has a generally cylindrically shaped polymeric body with a perforate sidewall sufficient for allowing ingress of a plating solution. The body includes a means such as a rib or protuberance for retaining it to a threaded part. The perforate sidewall allows the protector to be assembled to a part after threads have been formed and remain in place during plating with the threads exposed to a plating solution. Threaded parts with protectors may be placed atop one another in a barrel without incurring damage to the threaded portion and without significantly affecting the quality of the plating. Barrel-type plating offers significant economical manufacturing advantages over rack plating because more parts can be handled in the same size plating bath.

Other aspects and advantages of the invention are described in reference to the drawings wherein.

DESCRIPTION OF PREFERRED EMBODIMENT

Figure 1:
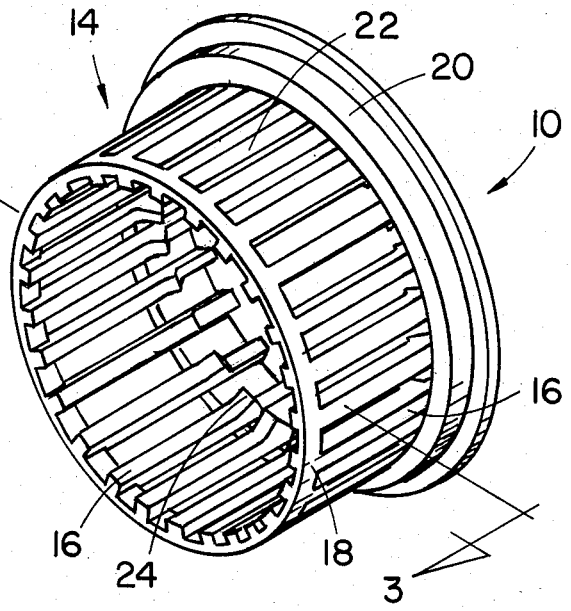
FIG. 1 is an isometric view of the thread protector of the invention.
Figure 2:
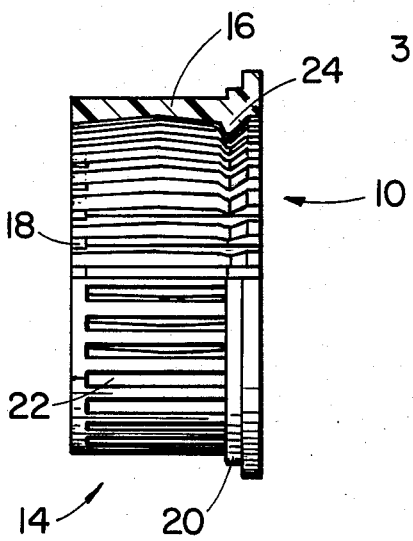
FIG. 2 is a partially cutaway side view showing a radial section.
Figure 3:
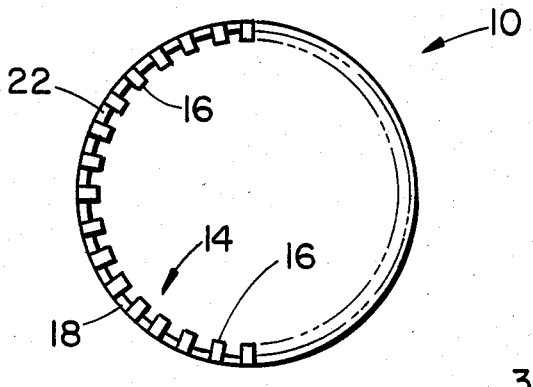
FIG. 3 is an axial cross section taken along the line 3—3 of FIG. 1.

In the drawings, a thread protector 10 has a generally cylindrically shaped polymeric body with a perforate sidewall 14. The body is made with any of the suitable polymeric materials such as polyethylene, polypropylene, ethylene vinyl acetate, and the natural or synthetic rubbers or blends thereof. The protector is easily formed using known injection molding processes. The term "generally cylindrically shaped" is meant to include the various sidewall shapes which a thread protector may have such as frustro-conical, ribbed, ridged, undulating, or the like. In all cases, the body forms a sleeve-like member.

In FIGS. 1 through 4, the perforate sidewall 14 is formed by a plurality of spaced apart circumjacent ribs 16 oriented lengthwise with the body axis. The ribs attach at each of their ends to circumferential rings 18, 20 and the space between the ribs define perforations 22. Optionally, one ring 20 is larger than the other 18 to provide a body taper or enhance stiffness. The ribs optionally extend radially inward of the rings to reduce the internal surface area that may be exposed to a threaded part. As shown, the protector may be tapered to accommodate a tapered thread. A retaining means in the form of a plurality of protuberances 24, projects radially inwardly juxtaposed one of the rings. Preferably, a protuberance projects from each rib and has a generally V-shaped cross section for engaging a thread of the threaded part.

Figure 4:
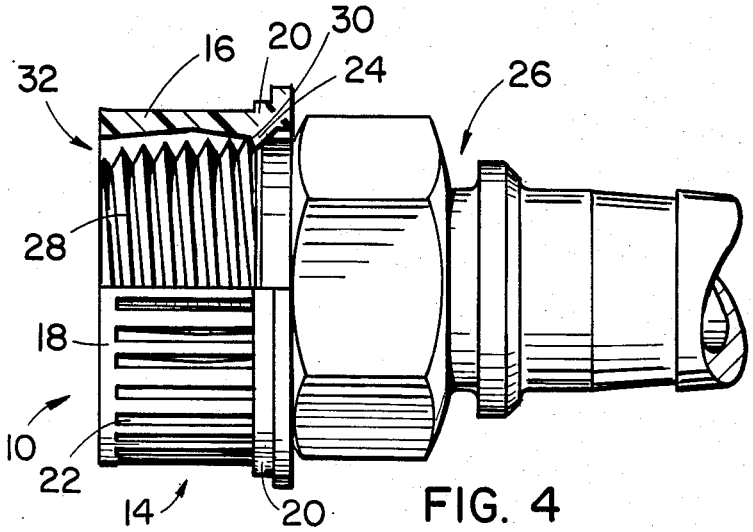
FIG. 4 is a partially cutaway side view of the protector as assembled on a threaded part (i.e., a male stem portion of a hose coupling).

The protector is assembled onto a threaded part such as a male stem 26 of a hose coupling, by screwing or by pushing it axially over the threads 28 to deflect the protuberances. The retaining means engages a thread portion 30 and holds the protector to the body juxtaposed the threads. Preferably, the protector is sized so there is a clearance 32 between the ribs and threads. Of course, the polymeric body may bend to an egg shape so that there is point or line contact of the ribs with the threads. The ribs define a means for protecting threads and a means for ingress of a plating solution past the protector and to the threads as is best seen in FIG. 4. The slots, or perforations between ribs allows entry of a plating fluid to the juxtaposed threads. Similarly, the circumferentially spaced protuberances allow ingress and flow of a plating fluid in the area where the protector is retained to the threaded member.

In use, the sleeve-like thread protector of the invention is positioned over a threaded portion of a member to be plated such as a male stem of a hose coupling as shown by FIG. 4. The retaining means engages the part and holds the protector with the ribs juxtaposed the threads. The protected part may then be stacked in bulk with other unplated parts for further processing such as degreasing and plating. The perforate wall exposes the threads to the plating solution so that the threads may be plated using known electrochemical processes. The plating solution is free to flow around the threads and protuberances without restriction that would affect acceptable plating. Either rack plating or barrel plating techniques may be used with the advantage that the protectors do not have to be repeatedly removed and replaced during part manufacture.

ADDITIONAL SPECIES

Figure 5:
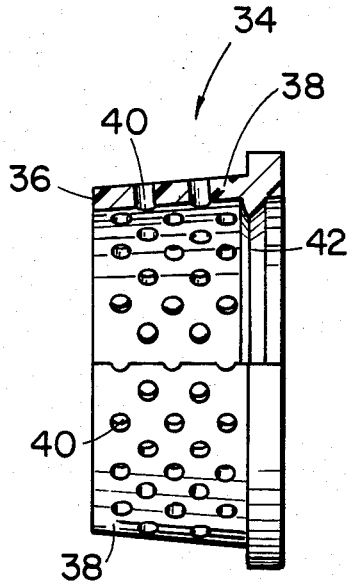
FIG. 5 is a partially cutaway side view showing an alternate form of the invention.

In FIG. 5, an alternate form of the invention is shown. A thread protector 34 has a generally cylindrical body 36 with a perforate sidewall 38 wherein the perforations are a plurality of circumjacent apertures 40. A retaining means in the form of a circumferential rib 42 extends from an inner surface of the body. The thread protector may be used as above described.

What is claimed is:

1. In a thread protector of the type with a generally cylindrically shaped polymeric body having continuous circumferential end portions, the improvement in the body comprising:

a perforate sidewall that includes (1) a means for protected threads and (2) a means for ingress of a plating solution to protected threads; and means for retaining the body to a threaded member.

2. The thread protector as claimed in claim 1 wherein the perforate sidewall comprises a plurality of spaced apart circumjacent ribs oriented with a longitudinal axis of said body.

3. The thread protector as claimed in claim 1 wherein the perforate sidewall comprises a sleeve having a plurality of circumjacent holes.

4. The thread protector as claimed in claims 2 or 3 wherein the body is substantially frustro-conically shaped.

5. A thread protector comprising:

a generally cylindrically shaped polymeric body having an axis and comprising a plurality of circumjacent ribs generally oriented with the body axis and defining a perforate sidewall;

a first circumferential ring interconnecting first ends of the ribs;

a second circumferential ring interconnecting second ends of the ribs; and a retaining means juxtaposed one of the circumferential rings and integral with the body.

6. The thread protectors as claimed in claim 5 wherein the ribs project radially inwardly from the rings.

7. The thread protector as claimed in claim 5 wherein the retaining means comprises a plurality of protuberances circumferentially arranged and projecting radially inwardly from the body.

8. The thread protector as claimed in claim 7 wherein a protuberance projects from each rib.

9. The thread protector as claimed in claim 7 wherein the protuberances have a radial cross section that is generally V-shaped.

10. The thread protector as claimed in claim 5 wherein the body is substantially frustro-conically shaped.

11. The thread protector as claimed in claim 5 wherein one of the rings is circumferentially larger than the other.

* * * * *